US008558650B2

(12) United States Patent
Paek

(10) Patent No.: US 8,558,650 B2
(45) Date of Patent: Oct. 15, 2013

(54) MOLDED CASE CIRCUIT BREAKER HAVING INSTANTANEOUS TRIP MECHANISM

(75) Inventor: Ki Ho Paek, Chungcheongbuk-Do (KR)

(73) Assignee: LS Industrial Systems Co., Ltd., Anyang-Si, Gyeonggi-Do (KR)

( * ) Notice: Subject to any disclaimer, the term of this patent is extended or adjusted under 35 U.S.C. 154(b) by 44 days.

(21) Appl. No.: 12/900,431

(22) Filed: Oct. 7, 2010

(65) Prior Publication Data

US 2011/0090031 A1 Apr. 21, 2011

(30) Foreign Application Priority Data

Oct. 20, 2009 (KR) ..... 10-2009-0099891

(51) Int. Cl.
*H01H 3/00* (2006.01)

(52) U.S. Cl.
USPC ..... 335/172; 335/147

(58) Field of Classification Search
USPC ..... 335/172
See application file for complete search history.

(56) References Cited

U.S. PATENT DOCUMENTS

| | | | | |
|---|---|---|---|---|
| 4,620,076 | A * | 10/1986 | Mrenna et al. | 200/304 |
| 4,691,180 | A * | 9/1987 | Grunert et al. | 335/6 |
| 5,872,495 | A | 2/1999 | DiMarco et al. | |
| 5,909,164 | A * | 6/1999 | Lee | 335/202 |
| 5,910,760 | A * | 6/1999 | Malingowski et al. | 335/167 |
| 6,140,897 | A * | 10/2000 | Mueller et al. | 335/172 |
| 6,144,271 | A | 11/2000 | Mueller et al. | |
| 6,480,082 | B1 | 11/2002 | Aihara et al. | |
| 6,614,334 | B1 * | 9/2003 | Gibson et al. | 335/202 |
| 6,747,534 | B1 * | 6/2004 | Mueller et al. | 335/38 |
| 6,750,743 | B1 | 6/2004 | Subramanian et al. | |
| 6,842,096 | B2 * | 1/2005 | Ciarcia et al. | 335/35 |
| 6,850,135 | B1 * | 2/2005 | Puskar et al. | 335/172 |
| 6,853,279 | B1 * | 2/2005 | Puskar et al. | 335/172 |
| 7,482,901 | B2 * | 1/2009 | Watanabe et al. | 335/201 |
| 2004/0227602 | A1 * | 11/2004 | Ciarcia et al. | 335/172 |
| 2006/0191873 | A1 * | 8/2006 | Asakawa et al. | 218/22 |

FOREIGN PATENT DOCUMENTS

| | | |
|---|---|---|
| CN | 1188977 | 7/1998 |
| JP | 5-334951 | 12/1993 |
| JP | 10-223118 | 8/1998 |
| JP | 2005-251757 | 9/2005 |
| JP | 2009-135115 | 6/2009 |

OTHER PUBLICATIONS

The State Intellectual Property Office of the People's Republic of China Application Serial No. 201010518549.1, Office Action dated Feb. 16, 2013, 6 pages.
Japan Patent Office Application Serial No. 2010-233853, Office Action dated Apr. 9, 2013, 2 pages.

* cited by examiner

*Primary Examiner* — Elvin G Enad
*Assistant Examiner* — Lisa Homza
(74) *Attorney, Agent, or Firm* — Lee, Hong, Degerman, Kang & Waimey

(57) ABSTRACT

A molded case circuit breaker having an instantaneous trip mechanism including main circuit units in a lower compartment of the molded case circuit breaker; a stationary contactor and a movable contactor; a switching mechanism in an upper compartment of the molded case circuit breaker and having an open position and a closed position; an instantaneous trip mechanism in the upper compartment and operating by an electromagnetic attraction in response to generation of a fault current, which triggers the switching mechanism to the open position; and an intermediate insulation barrier providing electrical insulation by partitioning the lower compartment and the upper compartment.

3 Claims, 5 Drawing Sheets

MOLDED CASE CIRCUIT BREAKER HAVING INSTANTANEOUS TRIP MECHANISM

CROSS-REFERENCE TO RELATED APPLICATION

Pursuant to 35 U.S.C. §119(a), this application claims the benefit of earlier filing date and right of priority to Korean Application No. 10-2009-0099891, filed on Oct. 20, 2009, the contents of which is incorporated by reference herein in its entirety.

BACKGROUND OF THE INVENTION

1. Field of the Invention

The present invention relates to a molded case circuit breaker, and particularly, to a molded case circuit breaker having an instantaneous trip mechanism.

2. Background of the Invention

In general, a molded case circuit breaker is an electrical device for protecting electric loads and an electrical circuit by tripping (breaking) circuits upon occurrence of fault currents, such as, an overcurrent or a short-circuit current.

Among such molded case circuit breaker, a current limitable molded case circuit breaker was introduced in which a direction of a current flowing in a stationary contactor is opposite to a direction of a current flowing in a movable contactor. The current limitable molded case circuit breaker typically uses a stationary contactor with a structure that a conductor extending from an externally exposed terminal into the molded case circuit breaker is then bent towards the terminal, namely, having a shape, like an alphabet "U" being laid. In the current limitable molded case circuit breaker, since the direction of the current flowing in the stationary contactor is opposite to the direction of the current flowing in the movable contactor, when a large fault current such as a short-circuit current flows, an electromagnetic repulsive force is generated between the stationary contactor and the movable contactor, and responsively, the movable contactor is automatically rotated to be separated from the stationary contactor. This operation is called as a current limiting operation, and a molded case circuit breaker having such current limiting function is referred to as a current limitable molded case circuit breaker. In a configuration of a molded case circuit breaker, before operating a trip mechanism, which triggers a switching mechanism to a trip position (i.e. circuit breaking position) in response to detection of a fault current, the current limiting function can immediately break a circuit upon occurrence of the large fault current, so it plays an important role.

On the other hand, a typical molded case circuit breaker is configured such that a direction of a current flowing in a stationary contactor matched with a direction of a current flowing in a movable contactor. The typical molded case circuit breaker generally uses a straight stationary contactor, namely, having a shape, like an alphabet "I" being laid. Since such typical molded case circuit breaker does not have the current limiting function, it should be separately provided with an instantaneous trip mechanism, which operates to trigger the switching mechanism to the trip position as soon as generation of a large fault current, such as a short-circuit current, before a trip mechanism detects the large fault current and triggers the switching mechanism to the trip position.

The present invention relates to the typical molded case circuit breaker having the instantaneous trip mechanism.

The typical molded case circuit breaker according to the related art is configured to perform multi-level operations including detecting a current on a circuit by means of a current transformer, deciding generation of a fault current and outputting a trip signal by means of an overcurrent relay corresponding to a controller, operating a trip actuator responsive to the trip signal, and triggering a switching mechanism to perform a trip operation by releasing a latch in response to the operation of the trip actuator. Thus, the typical molded case circuit breaker according to the related art has problems that a large current, such as a short-circuit current, cannot be instantaneously blocked and a time delay is caused accordingly.

Furthermore, the typical molded case circuit breaker according to the related art has problems of a time delay and a risk of mis-operation upon an electrical signal generation and transfer, a signal processing, an electrical operation responsive to a control signal, such as several steps of detecting a current on a circuit by means of a circuit device, such as a current transformer, transferring a current detect signal via a signal line, processing the signal according to a program by a microprocessor within the over current relay, deciding generation of a fault current, outputting a trip signal to transfer to a trip actuator and driving the trip actuator.

SUMMARY OF THE INVENTION

Therefore, to address those problems of the related art, an object of the present invention is to provide a typical molded case circuit breaker having a mechanical instantaneous trip mechanism, capable of performing an instantaneous trip operation upon breaking a large current, such as a short-circuit current.

To achieve these and other advantages and in accordance with the purpose of the present invention, as embodied and broadly described herein, there is provided a molded case circuit breaker including: a main circuit unit present in a lower compartment of the molded case circuit breaker, and configured to open or close a circuit by having a stationary contactor and a movable contactor rotatable to contact with or separated from the stationary contactor; a switching mechanism present in an upper compartment of the molded case circuit breaker, and having an open position where the switching mechanism is connected to the main circuit unit to drive the main circuit unit to open a circuit, and a closing position where the switching mechanism drives the main circuit unit to close a circuit; an instantaneous trip mechanism present in the upper compartment, and operating by an electromagnetic attraction in response to generation of a fault current on a circuit so as to trigger the switching mechanism to the open position; and an intermediate insulation barrier installed between the upper compartment and the lower compartment for electrical insulation by partitioning the lower compartment having the main circuit unit and the upper compartment having the instantaneous trip mechanism and the switching mechanism.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are comprised to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the preferred embodiments according to the present invention, with reference to the accompanying drawings. For the sake of brief description with reference to the drawings, the same or equivalent components will be provided with the same reference numbers, and description thereof will not be repeated.

Hereinafter, description will be given of a configuration of a molded case circuit breaker in accordance with an exemplary embodiment with reference to FIG. 1 longitudinal sectional view showing a configuration of a molded case circuit breaker having a main circuit unit in a lower compartment, an insulation barrier, and a switching mechanism and an instantaneous trip mechanism in an upper compartment in accordance with the present invention, FIG. 2 which is a longitudinal perspective view showing the molded case circuit breaker of FIG. 1 in a downwardly inclined state, and FIG. 3 which is a disassembled perspective view of the molded case circuit breaker.

Figure 1:
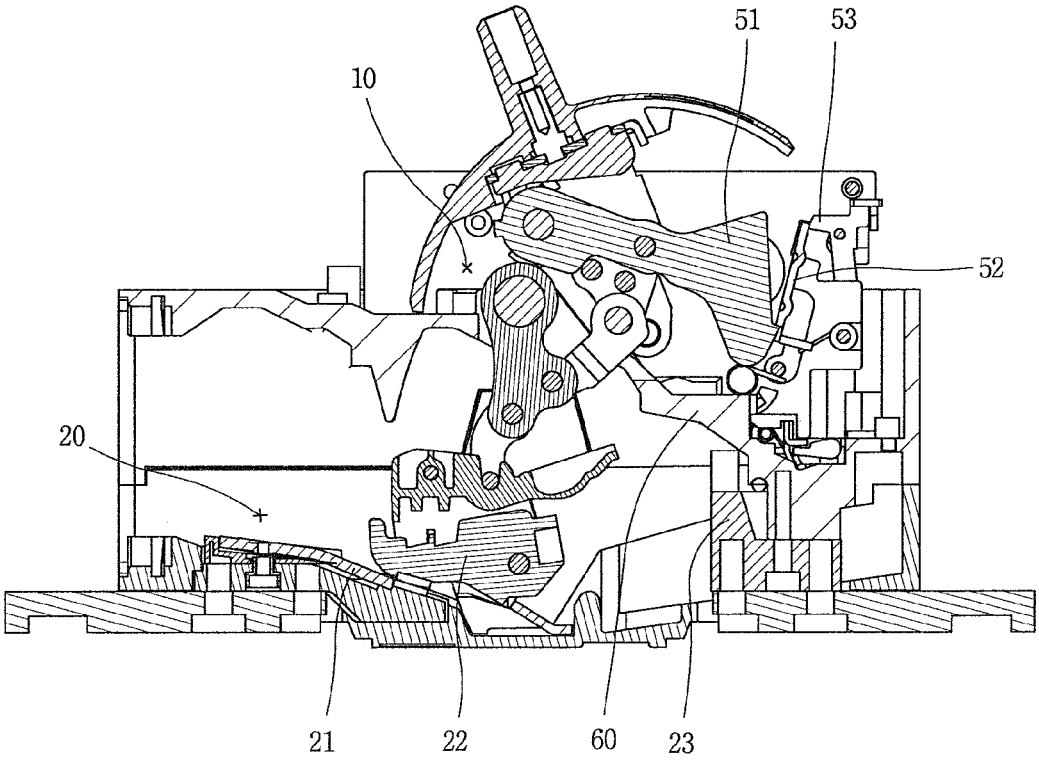
FIG. 1 is a longitudinal sectional view showing a configuration of a molded case circuit breaker having a main circuit unit in a lower compartment, an insulation barrier, and a switching mechanism and an instantaneous trip mechanism in an upper compartment in accordance with the present invention.
Figure 2:
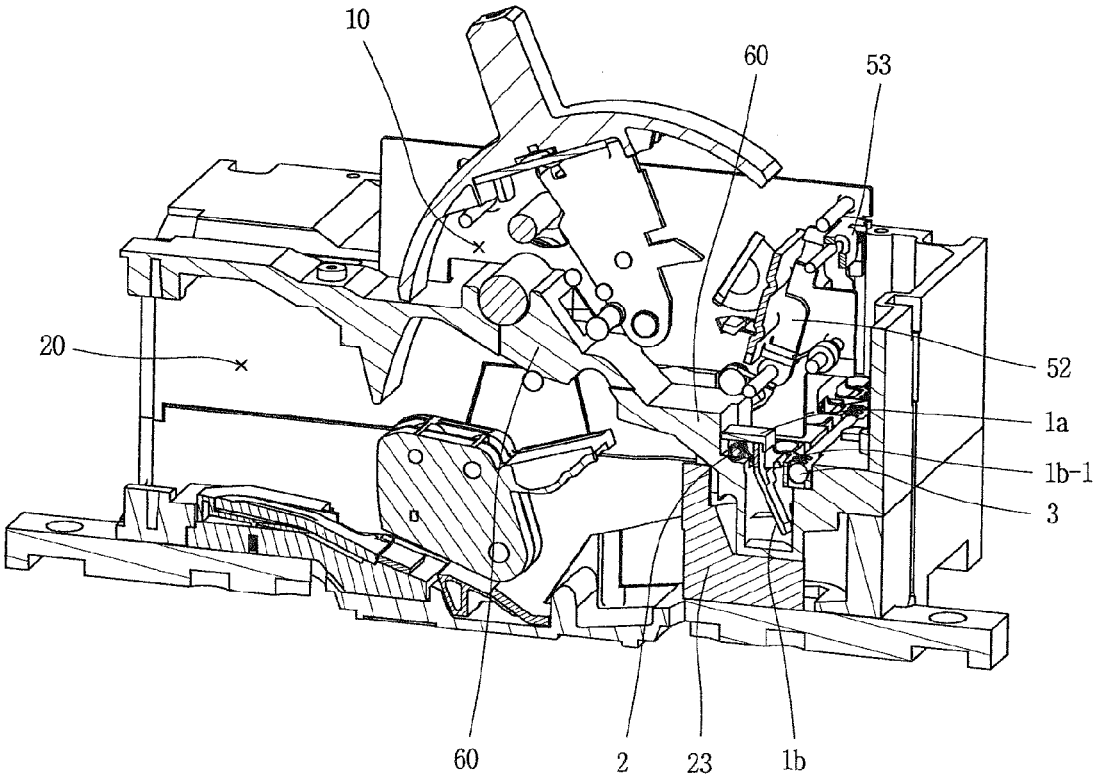
FIG. 2 is a longitudinal perspective cross sectional view showing the molded case circuit breaker of FIG. 1 in a downwardly inclined state.
Figure 3:
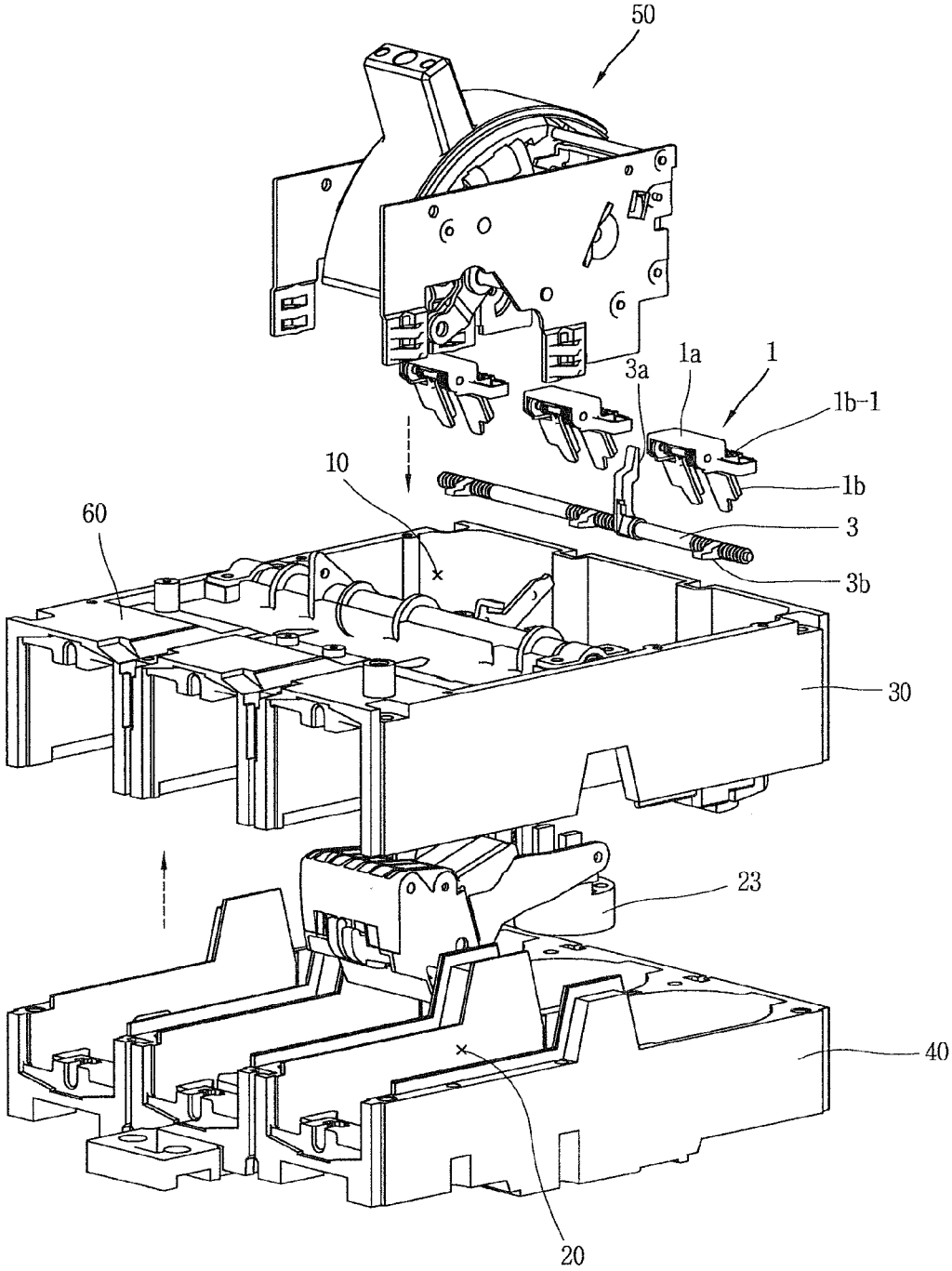
FIG. 3 is a disassembled perspective view of the molded case circuit breaker.

Referring mainly to FIG. 3 and supportively to FIGS. 1 and 2, a molded case circuit breaker according to one exemplary embodiment comprises a main circuit unit (i.e., 21, 22, 23), a switching mechanism 50, an instantaneous trip mechanism (i.e., 1, 2, 3) and an intermediate insulation barrier 60.

Also, the molded case circuit breaker according to the one exemplary embodiment may further comprise an upper outer casing 30 and a lower outer casing 40 corresponding to an enclosure for accommodating the main circuit unit (i.e., 21, 22, 23), the switching mechanism 50, the instantaneous trip mechanism (i.e., 1, 2, 3) and the intermediate insulation barrier 60.

The intermediate insulation barrier 60 having one side concave (i.e., the right side in FIGS. 1 and 2) may be disposed at the upper outer casing 30. An upper compartment 10 may be formed above the upper outer casing 30 based upon the intermediate insulation barrier 60. That is, the upper compartment 10 may be formed by the intermediate insulation barrier 60 and walls of the upper outer casing 30 present upper than the intermediate insulation barrier 60.

Referring to FIGS. 1 to 3, in the configuration of the upper outer casing 30 and the lower outer casing 40, a lower compartment 20 may be formed below the intermediate insulation barrier 60. That is, the lower compartment 20 may be formed by the intermediate insulation barrier 60, the upper outer casing 30 present below the intermediate insulation barrier 60 and walls of the lower outer casing 40.

The main circuit unit (i.e., 21, 22, 23) is located in the lower compartment 20. Also, the main circuit unit (i.e., 21, 22, 23), which is a means for switching on or off a circuit or providing a passage through which a current flows on a circuit, may comprise a stationary contactor 21, a movable contactor 22 rotatable to contact with or separated from the stationary contactor 21, and an electric conductor 23 electrically connected to the movable contactor 22 to provide a passage for allowing a current flow on the circuit.

The switching mechanism 50 may be disposed in the upper compartment 10, and have an open position at which it is connected to the main circuit unit 21, 22, 23 so as to drive the main circuit unit 21, 22, 23 to open (break) a circuit, and a closing position at which it drives the main circuit unit 21, 22, 23 to close (connect) the circuit. The switching mechanism 50 may comprise a latch 51, a latch holder 52 and a nail 53.

The latch 51 may have a position for locking (restricting) a trip spring, which supplies an elastic force for a trip operation, in a state charged with elastic energy, and a position for unlocking (releasing) the trip spring so as to discharge the elastic energy.

The latch holder 52 may be rotatable to a position for locking the latch 51 and a position for unlocking the latch 51. The latch holder 52 may be elastically biased in a direction of releasing the latch 51 by virtue of a torsion spring (reference numeral not given).

The nail 53 may be disposed at a position for pressing the latch holder 52 to be rotated, and also be rotated to press the latch holder 52 and thereby release the latch 51.

Also, the switching mechanism 50 may further comprise a handle, a trip spring (so-called main spring, not shown), a holder, a rotary shaft, an upper link, a lower link and the like.

Here, the handle may act as a manual manipulation means for the molded case circuit breaker.

The trip spring may be charged with elastic energy in a reset state (i.e., an off-state of the handle) of the molded case circuit breaker and discharge the charged elastic energy upon a trip operation, thereby supplying a driving force for driving the movable contactor 22 of the main circuit unit 21, 22, 23 to a trip position. The trip spring may have one end supported by the handle and another end supported by a connection pin between the upper and lower links to be explained later.

The holder may rotatably support the movable contactor 22 and be prepared for each of three alternating current (AC) phases.

The rotary shaft may support all of the holders, for example, of the three phases to be simultaneously rotated.

The upper and lower links may be connected between the latch 51 and the rotary shaft for rotation of the rotary shaft.

Those individual components of the switching mechanism 50 and their functions are well known, so detailed description thereof will not be repeated.

The instantaneous trip mechanism (i.e., 1, 2, 3) may comprise an armature assembly 1, an instantaneous trip spring 2 and a cross bar 3.

The armature assembly 1 may be installed to face the electric conductor 23 comprised in the main circuit unit 21, 22, 23, with an interval therebetween. The armature assembly 1 may be formed of a strong magnetic substance. When a fault current flows on the conductor 23, the armature assembly 1 may be attracted by the conductor 23 to be rotated. The armature assembly 1 may comprise an armature base 1*a*, a rotating piece 1*b* and a pressing member 1*b*-1.

The armature base 1*a* is a base of the armature assembly 1, and may be fixedly supported at the upper outer casing 30 by virtue of a supporting shaft.

The rotating piece 1*b* may be supported as its upper end is inserted in the armature base 1*a*. A lower end of the rotating piece 1*b* is a free end, which may downwardly extend from the armature base 1*a*. Also, the rotating piece 1*b* may be configured as a thin long leaf spring formed of a strong magnetic substance.

The pressing member 1*b*-1 may be a member, which is connected with or integrally formed with the rotating piece 1*b* so as to be integrally rotated together. The pressing member 1*b*-1 may extend towards the cross bar 3, namely, in a right direction in FIG. 2.

The instantaneous trip spring 2 may be installed to be contactable with the armature 1 so as to apply an elastic force to the armature 1. Especially, the instantaneous trip spring 2 may be implemented according to the embodiment as a torsion spring, which is installed such that a body thereof is supported by the support shaft, which supports the armature base 1*a*, and an end portion thereof is contactable with the rotating piece 1*b*, so as to apply an elastic force to the rotating piece 1*b* to be moved away from the conductor 23 (i.e., in the right direction in FIG. 2). Accordingly, when a normal current flows on the conductor 23, the instantaneous trip spring 2 may return the armature 1, especially, the rotating piece 1*b* to its original position. Also, when an instantaneous trip current (i.e., a large fault current such as a short-circuit current) flows, the instantaneous trip spring 2 may allow the armature 1, especially, the rotating piece 1*b* to be rotated close to the conductor 23. That is, when the instantaneous trip current (i.e., a large fault current such as a short-circuit current) flows, the elastic force applied from the instantaneous trip spring 2 to the rotating piece 1*b* may be smaller than a magnetic attraction, which is generated due to the large fault current flowing on the conductor 23 so as to attract the rotating piece 1*b* towards the conductor 23.

The cross bar 3 may be a member having a body approximately in a bar shape. The body of the cross bar 3 may be rotatably supported by a sidewall of the upper outer casing 40 and be rotatable by being pressed by the armature 1. The cross bar 3, referring to FIGS. 3 to 5, may comprise an upper extension portion 3*a* extending from the body towards the nail 53 so as to press and rotate the nail 53 upon being rotated. The cross bar 3 may also comprise a forward extension portion 3*b* extending from the body towards the armature 1 (i.e., extending in the left direction in FIGS. 4 and 5).

Meanwhile, the intermediate insulation barrier 60 comprised in the molded case circuit breaker according to the one exemplary embodiment may be installed between the upper compartment 10 and the lower compartment 20 for an electrical insulation by separating the lower compartment 20 having the main circuit unit 21, 22, 23 and the upper compartment 10 having the instantaneous trip mechanism 1, 2, 3 and the switching mechanism 50. The intermediate insulation barrier 60 may be made of synthetic resin having electrically insulating properties or made of synthetic resin having electrically insulating properties, as the same material as that constructing the upper and lower outer casing 30 and 40. The intermediate insulation barrier 60 may be integrally formed with the upper outer casing 30 according to the embodiment.

Hereinafter, description will be given of an operation of the molded case circuit breaker having such configuration with reference to FIGS. 4 and 5.

Figure 4:
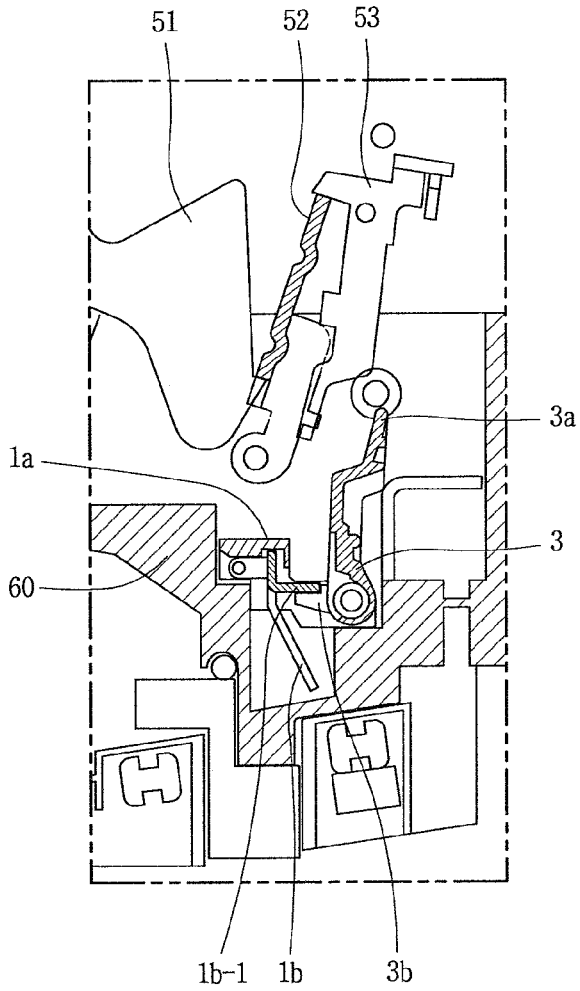
FIG. 4 is a partial side view showing a state prior to a trip operation of the molded case circuit breaker.

FIG. 4 is a side view showing a state prior to a trip operation of the molded case circuit breaker. In the state shown in FIG. 4, when a large current such as a short-circuit current flows on a circuit, the large current flows via the conductor 23 shown in FIG. 2. Accordingly, a large magnetic attraction is generated around the conductor 23 to attract the rotating piece 1*b* of the armature assembly 1.

Figure 5:
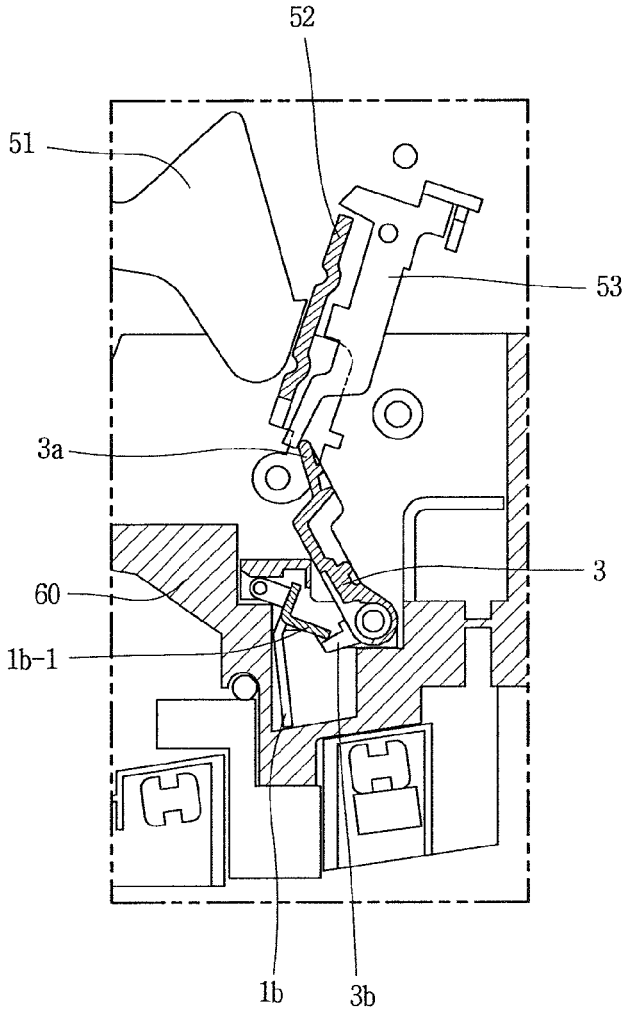
FIG. 5 is a partial side view showing a state upon a trip operation of the molded case circuit breaker.

The rotating piece 1*b* is then rotated clockwise from the state of FIG. 4 to the state of FIG. 5. In response to the clockwise rotation of the rotating piece 1*b*, the pressing member 1*b*-1 integrally formed with the rotating piece 1*b* is rotated in the clockwise direction. Upon the clockwise rotation, the pressing member 1*b*-1 presses the forward extension portion 3*b* of the cross bar 3 to be rotated in a counterclockwise direction from the state of FIG. 4 to the state of FIG. 5.

Accordingly, the upper extension portion 3*a* of the cross bar 3, integrally formed with the forward extension portion 3*b*, is rotated in the counterclockwise direction to push the front nail 53, which is then rotated in the clockwise direction.

When the restricted latch holder 52 is released due to the clockwise rotation of the nail 53, the latch holder 52 is rotated in the clockwise direction by virtue of the torsion spring so as to release the latch 51. Consequently, the latch 51, as aforesaid, is rotated in the counterclockwise direction by the elastic force of the trip spring. Although the succeeding operations are not shown, a lower end portion of the trip spring, which is shrunk to its original position, pulls up the connection pin, and accordingly the upper and lower links are raised. The rotary shaft connected to the lower link is then rotated in the clockwise direction to make the holder rotated in the clockwise direction. The movable contactor (22 in FIG. 1) supported by the holder is accordingly separated from the stationary contactor 21, thereby completing a trip (breaking) operation.

For a closing operation, upon a closing position manipulation after setting the handle to an off position (i.e., reset position), as shown in FIG. 1, the latch 51 is restricted by the latch holder 52 and the movable contactor 51 contacts the stationary contactor 21, accordingly, the circuit is connected in a conductible state.

The molded case circuit breaker according to the present invention has the configuration that the upper compartment and the lower compartment are separated by the intermediate insulation barrier, the switching mechanism and the mechanical instantaneous trip mechanism are installed in the upper compartment and the main circuit unit is installed in the lower compartment, whereby a reliable instantaneous trip operation may be allowed without a time delay and also the switching mechanism and the instantaneous trip mechanism within the upper compartment can be protected from are due to the intermediate insulation barrier so as to improve a trip performance.

In the molded case circuit breaker, the instantaneous trip mechanism can be implemented by a simplified mechanical structure, which merely comprises the armature installed to face the electric conductor comprised in the main circuit unit, with an interval therebetween, and formed of a strong magnetic substance, and the instantaneous trip spring installed to be contactable with the armature so as to apply an elastic force thereto.

In the molded case circuit breaker, the instantaneous trip mechanism can further comprise the cross bar, which is rotated by being pressed by the armature and has an extension portion extending towards the nail, as one component of the switching mechanism, so as to press and rotate the nail when the cross bar is rotated, whereby the switching mechanism can be triggered to mechanically perform a trip operation in response to the pressing of the cross bar.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A molded case circuit breaker comprising:

a plurality of main circuit units located in a lower compartment of the molded case circuit breaker, wherein each of the plurality of main circuit units is configured to open or close a circuit via a stationary contactor and a movable contactor, wherein the movable contactor is rotatable to make contact with or separate from the stationary contactor;

a switching mechanism located in an upper compartment of the molded case circuit breaker, the switching mechanism connected to each of the plurality of main circuit units and having:

an open position in which the switching mechanism drives open a circuit, and a closed position in which the switching mechanism drives each of the plurality of main circuit units to close the circuit;

an instantaneous trip mechanism located in the upper compartment and operated via electromagnetic attraction in response to generation of a fault current in the circuit, wherein the instantaneous trip mechanism causes the switching mechanism to be in the open position; and an intermediate insulation barrier installed commonly for the plurality of main circuit units between the upper compartment and the lower compartment and configured to provide electrical insulation between the switching mechanism and instantaneous trip mechanism located in the upper compartment and the plurality of main circuit units located in the lower compartment by partitioning the lower compartment and the upper compartment, wherein the intermediate insulation barrier is a portion of and forms a single body with an upper outer casing of the molded case circuit breaker, and wherein the intermediate insulation barrier is configured to substantially cover the entire area of the lower compartment.

2. The circuit breaker of claim 1, further comprising:

an electric conductor located in each of the plurality of main circuit units with an interval between each of the plurality of main circuit units, wherein the instantaneous trip mechanism comprises:

an armature installed to face each electric conductor and made of a strong magnetic substance such that the armature is rotatably attracted by each conductor when a fault current flows through the conductor; and an instantaneous trip spring that is contactable with the armature to apply an elastic force to the armature in order to return the armature to an original position when a normal current flows through each conductor, wherein the instantaneous trip spring applies a predetermined elastic force to the armature when the armature is rotated in response to an instantaneous trip current flowing, and wherein the predetermined elastic force is smaller than a rotational force of the armature.

3. The circuit breaker of claim 2, wherein the switching mechanism comprises:

a latch having a restricted position and a released position;

a latch holder rotatable between a first position for restricting the latch and a second position for releasing the latch; and a nail configured to cause the latch holder to rotate to the second position, wherein the instantaneous trip mechanism further comprises a cross bar that is rotatable upon being pressed by the armature and having an extension portion extending towards the nail in order to press and rotate the nail when the cross bar is rotated.

* * * * *